United States Patent [19]

De Montalembert

[11] Patent Number: 4,656,696

[45] Date of Patent: Apr. 14, 1987

[54] DEVICE FOR RETAINING AN ARTICLE ON AN ITEM OF CLOTHING

[76] Inventor: Bernard De Montalembert, 9, rue Saint-Louis, 77300 Fontainebleau, France

[21] Appl. No.: 810,922

[22] Filed: Dec. 19, 1985

Related U.S. Application Data

[63] Continuation-in-part of Ser. No. 660,955, Oct. 15, 1984, Pat. No. 4,570,302.

[30] Foreign Application Priority Data

Oct. 17, 1983 [CH] Switzerland ..... 5637/83

[51] Int. Cl.[4] ..... A45F 5/02

[52] U.S. Cl. ..... 24/3 R; 24/3 H; 24/3 K

[58] Field of Search ..... 24/3 K, 3 H, 3 R; 150/134

[56] References Cited

U.S. PATENT DOCUMENTS

| | | | |
|---|---|---|---|
| 652,245 | 6/1900 | Cameron | 24/3 H |
| 1,041,664 | 10/1912 | Olson | 150/134 |
| 1,417,129 | 5/1922 | Armstrong | 24/3 K |
| 1,609,347 | 12/1926 | Dee | 24/3 K |
| 1,666,975 | 4/1928 | Monahan | 24/3 K |
| 1,698,028 | 1/1929 | Sfiris | 24/3 K |
| 2,775,804 | 1/1957 | Ayoub | 24/3 K |
| 2,823,434 | 2/1958 | Van Buren, Jr. | 24/3 K |
| 2,869,198 | 1/1959 | Clevett, Jr. | 24/3 K |
| 3,357,615 | 12/1967 | Hill | 24/3 K |
| 4,113,156 | 9/1978 | Brito | 24/3 K |

FOREIGN PATENT DOCUMENTS

| | | | |
|---|---|---|---|
| 974005 | 2/1951 | France | 24/3 R |
| 1207148 | 2/1960 | France . | |

*Primary Examiner*—Victor N. Sakran

*Attorney, Agent, or Firm*—Kane, Dalsimer, Kane, Sullivan and Kurucz

[57] ABSTRACT

The device for retaining an article includes a stiff member for engaging simultaneously an object (such as a wallet) to a clothing article, and a flexible member which has a first and a second position with respect to said stiff member. In the first position the flexible member engages the clothing article with a spike so that the object cannot be removed.

10 Claims, 10 Drawing Figures

DEVICE FOR RETAINING AN ARTICLE ON AN ITEM OF CLOTHING

RELATED APPLICATIONS

This is a continuation-in-part application to application Ser. No. 660,955, filed Oct. 15, 1984, now U.S. Pat. No. 4,570,302.

BACKGROUND OF THE INVENTION

The present invention relates to a device for retaining an article on an item of clothing, for example retaining a billfold in a pocket, the device being intended to be attached to the article to be retained, and comprising a rigid U-shaped staple provided with means for attachment to the said article, on which staple is mounted, on the one hand, a resilient member the end of which is intended to penetrate into the item of clothing on which the said article is located, in case of relative movement tending to separate the said article from the said item of clothing, and, on the other hand, a control means mounted to slide on the staple between two positions, the said resilient member being aligned obliquely, from one wing of the staple to the other, towards the base of this staple, in a first position of the control means, and being moved away from the opposite wing in the second position of the control means.

THE PRIOR ART

A billfold security device, of the type mentioned above, is described in French Pat. No. 1,207,148. In this prior art device, the resilient member is formed by a curved leaf spring attached by a rivet to one of the wings of the staple, the end of the said spring bearing, at rest, against the opposite wing of the staple, by one edge. A slide enables the spring to be straightened against the wing to which it is attached. The edge by which the spring bears on the fabric is liable to cut or tear the fabric. The releasing of the spring, which is accomplished by rotation, may likewise result in tearing of the fabric.

Needle devices (French Pat. No. 462,520, U.S. Pat. No. 3,273,619, German Pat. No. 403,398) are furthermore known which comprise a needle aligned obliquely upwards and capable of being retracted by means of a sliding member. In all these embodiments, the needle is not covered in the working position and may injure the user when the wallet is manipulated. In the devices according to U.S. Pat. No. 3,273,619 and German Pat. No. 403,398, the spring is released by gravity, requiring absolute cleanliness, which is difficult to maintain, in order to enable the sliding piece to slide.

SUMMARY OF THE INVENTION

The primary object of the invention is to provide a simpler device which is reliable and non-hazardous to use and does not spoil the fabric.

For this purpose, in the device according to the invention, a single wire simultaneously forms the sliding member and the retaining member, in this case a spike. Retraction of the spike is accomplished by a combined transitory and rotary movement, permitting the spike to be withdrawn from the fabric without risking tearing it. More precisely the control means and the resilient means are formed by a single piece comprising a resilient, bent and pointed metal wire, the part of the wire possessing the spike passing obliquely through one of the wings of the staple through a cut-out so as to reach, at least approximately, the opposite wing, in the first position of the control means, and to move away from the opposite wing, flexing and bearing on one end of the cut-out, in the second position of the control means, in a manner, such that the spike moves away from the opposite wing, performing a combined transitory and rotary movement.

BRIEF DESCRIPTION OF THE DRAWINGS

The attached drawing illustrates, by way of example, a preferred embodiment of the invention.

DESCRIPTION OF THE PREFERRED EMBODIMENT

Figure 1:
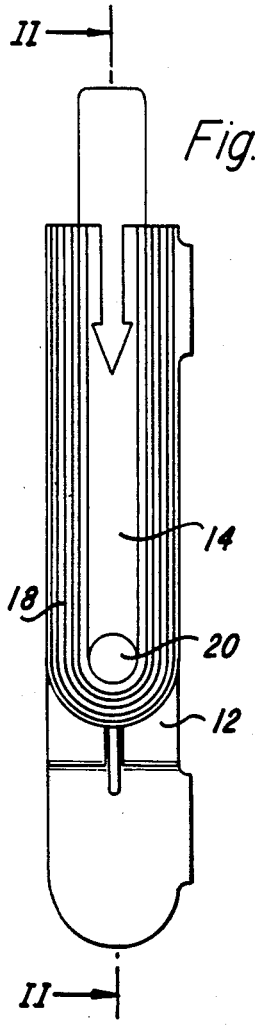
FIG. 1 is a frontal view of the device.

Referring now to the drawings, and more particularly to FIGS. 1-5, a device for retaining an article comprises a generally U-shaped member 10 having a first arm 12 and a second arm 14 which cooperate to engage a clothing article such as the outer flap of a pocket 16. An outer surface of arm 14 is provided with a plurality of decorative grooves 18 and a button 20. The second or inner arm 12 is provided with an upper and a lower bracket 22, 24 which have been bent to overlap the arm. The two brackets are provided with threaded holes 26, 28 for engaging respective screws 30, 32. These screws are used to secure the device permanently to the article that is to be retained, such as a wallet, by pinching a portion of the article between the screw and arm 12. A plate 34 is also secured by the screws to member 10 and is used to maintain the device flat against the retained article as shown more clearly in FIG. 2. Arm 12 is bent into five relatively straight sections, sequentially indicated by the numerals 36, 38, 40, 42 and 44. Sections 36 and 44 are coplanar and are disposed in parallel with arm 14. Section 40 is also parallel to arm 14 but is closer to the arm than sections 36, 44. Section 38 is substantially perpendicular to sections 36, 40 while section 42 forms an angle of approximately 135° with sections 40 and 44. Section 40 is provided with a slight bulge 46 to cooperate with arm 14 for pinching pocket flap 16. Finally, section 38 has a cut-out 48, section 40 has a cut-out 50 and section 42 has a cut-out 52.

Figure 2:
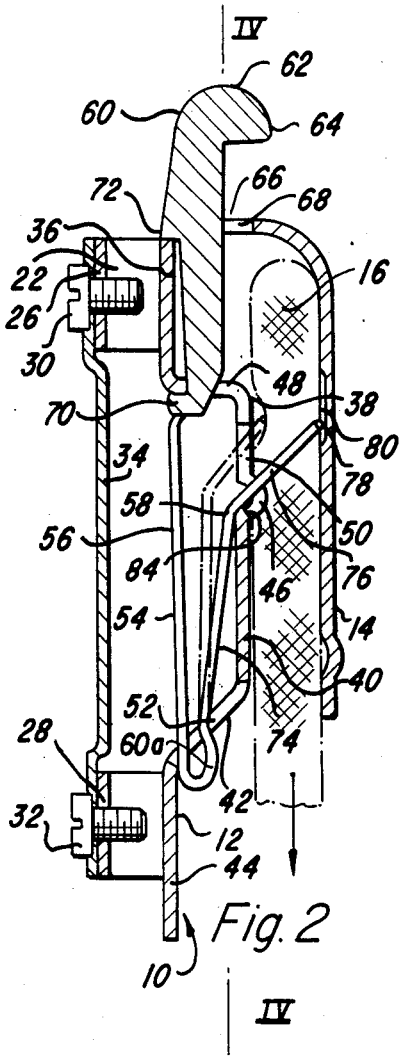
FIG. 2 is a lateral view thereof.
Figure 5:
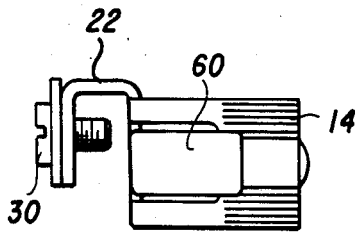
FIG. 5 is an end view of the device.

The device also has a stainless steel wire 54 which is bent into the shape shown in FIG. 2. Wire 54 is also U-shaped and it consists of a first arm 56, a second arm 58 and an intermediate, accurate segment 60*a*. Arm 56 terminates in a cap 60. The cap has a rounded head 62 with a nose 64.

A horizontal portion 66 joins arms 12 and 14, which is formed with a cut-out 68. Cap 60 extends downwardly through cut-out 68 and terminates in a hooked segment 70. The cap is also provided with a rearward lip 72. Wire arm 58 has a lower straight section 74 and an upper section 76 and terminates in a sharp point 78. A shallow pit 82 is formed in arm 14 to accommodate point 78 as shown.

The device is operated as follows. In its normal position the device is secured to flap 16 by the co-action of arms 12, 14 and by the wire section 76 which passes through flap 16 with the point 78 resting in pit 80. The natural spring action of wire 54 tends to push the wire upward with respect to member 10, however it is not allowed to do so because segment 70 engages the lower edge of section 36. Any attempt to remove a retained article attached to the device would cause flap 16 to move in the direction shown by the view of FIG. 2, which is opposed by the wire section 76. An accidental force on head 60 downwards similarly is ineffective because of the engagement between lip 72 and the upper edge of section 36. Thus, in the configuration of FIG. 2, the device may be removed from the flap 16 only by ripping or cutting the flap.

Figure 3:
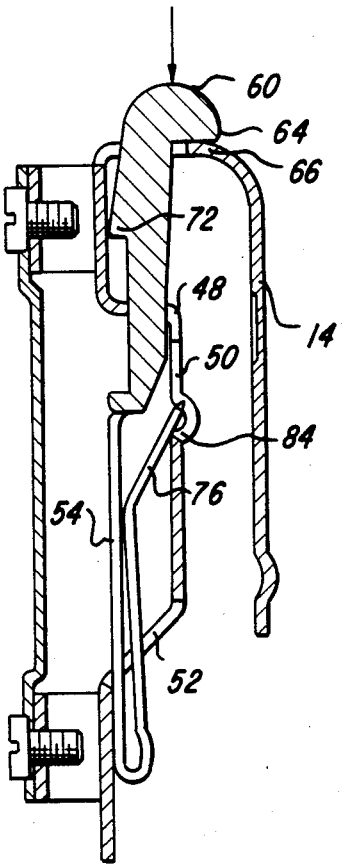
FIG. 3 is a lateral view with the pin disengaged.
Figure 4:
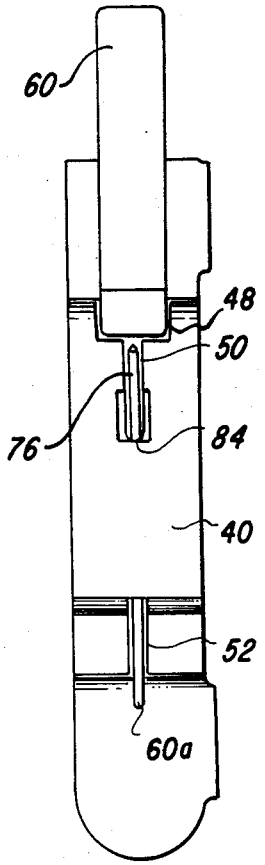
FIG. 4 is a partial front view of the device taken along line IV—IV of FIG. 2.

The device (and the retained article) may be removed by shifting cap 60 slightly forward until lip 72 clears the upper edge of section 36 and pushing the cap downward as shown in FIG. 3, until nose 64 contacts section 66. (It should be noted that cut-out 68 is not big enough to let cap 60 through, as shown in FIG. 3). The downward translation of cap 60 is transmitted to the wire, which also moves downward with arcuate segment **60*a* passing through or past cut-out 52. At the same time, wire arm section 76 is engaged by a lower edge 84 of cut-out 50 and in a simultaneous translation and rotation is withdrawn from flap 16 to allow the device to be removed from a pocket. The downward movement of the wire is stopped by the nose 64 engaging section 66. As soon as the cap is released, it springs back to the position of FIG. 3**.

Figure 6:
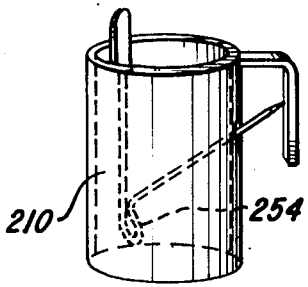
FIG. 6 shows a second embodiment of the device with two wires.

In FIG. 6, a second embodiment is shown with a tubular housing 210 and a wire 254 which function exactly like their counterparts 10, 54 of the preferred embodiment. This embodiment is suited for articles with rod-shaped elements (such as eye glasses with temple pieces) which are slipped into the housing 210.

Figure 7:
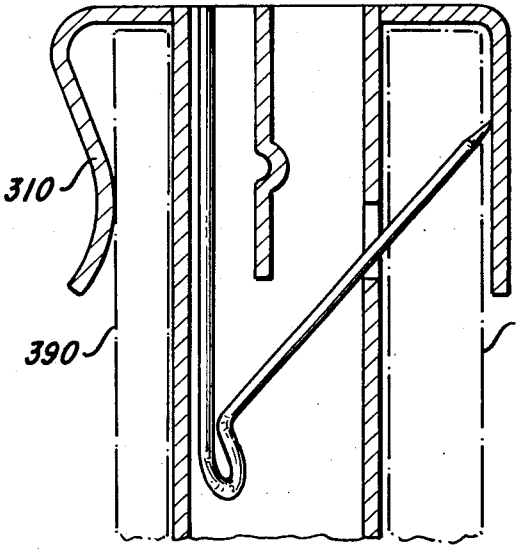
FIG. 7 shows a third embodiment of the device suitable for eye-glasses.

In the embodiment FIG. 7, housing 310 is not cylindrical but rectangular so that it may be attached to a belt 390 and a clothing article (such as a skirt) 316.

Figure 8:
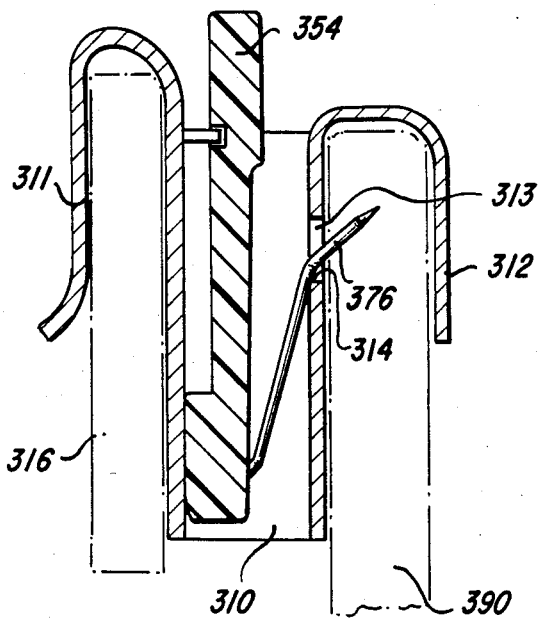
FIG. 8 shows a fourth embodiment suitable for attaching a belt to a clothing article.

The embodiment of FIG. 8 is best suited for protecting flat thin objects such as identification badges. In this embodiment, a stiff member 310 is provided which is tubular and has a rectangular cross-section. The opposite walls of the tube are cut and bent to form two wings 311 and 312. The wing 311 receives a belt 316 and the wing 312 the skirt. A flexible wire 376 with spike is fixed on a rigid sliding part 354 of plastic. The tube 310 has a lateral aperture 313 for the wire 376. The wire is abutting against the wedge 314 of the aperture.

Figure 9:
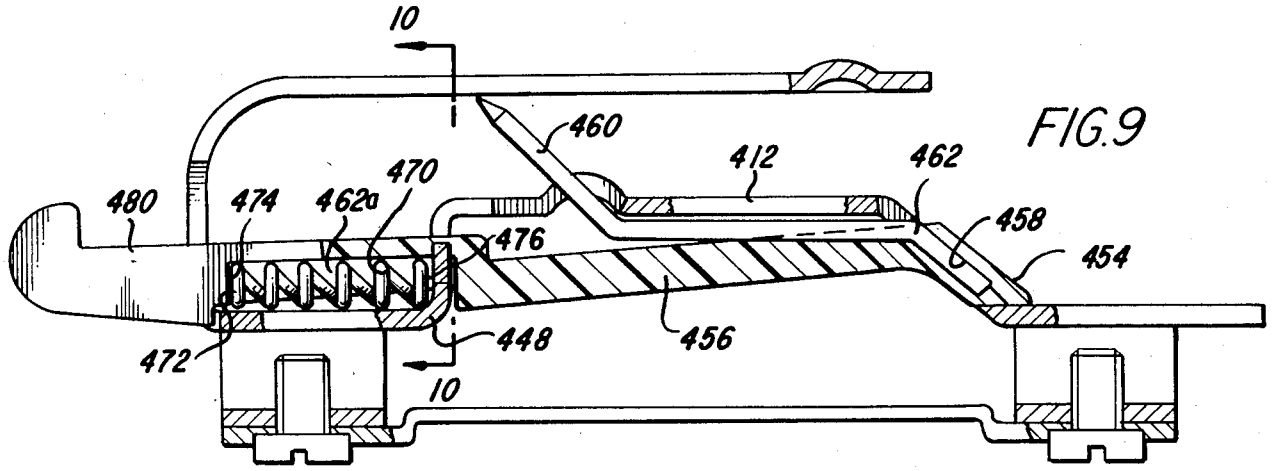
FIG. 9 shows a fifth embodiment suitable for an identification badge.
Figure 10:
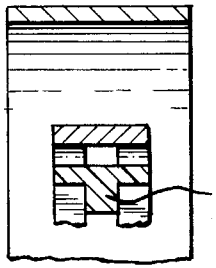
FIG. 10 shows a partial cross-sectional view of the embodiment of FIG. 9 taken along line 10—10.

In the embodiment of FIGS. 9 and 10 the wire 54 is replaced by a member 454 comprising a plastic, relatively straight portion 456 having a lower hole 458 for holding a spike 460. The angle between portion 456 and a bottom section 462 of spike 460 can be made much smaller than in the previous embodiment. Cap 480 is joined to the portion 454 as shown and is provided with a hollow section **462*a* for housing a spring 470. The upper end 472 of the spring abuts an inner shoulder 474 of the cap, while its lower end 476 abuts portion 448 of arm 412. The spring thus urges member 454 and spike 460 upwardly with respect to arm 412**.

Obviously numerous other modifications may be made to the invention without departing from its scope as defined in the appended claims.

What is claimed is:

1. A device for retaining an object fastened to a clothing article comprising:

a stiff member having means for releasably engaging said article, means for securing said stiff member to said object and at least one cutout;

a flexible member having an end section, said flexible member being attached to said stiff member, and translatable between a first position wherein said stiff member is secured to said article and a second position wherein the stiff member is removable from said article, said flexible member cooperating with said cutout to rotate said end section to penetrate said clothing article as said flexible member is translated from said second to said first position, whereby said stiff member is prevented from being released from said article by said flexible member in said first position, said flexible member being urged toward said first position by its own spring action.

2. The device of claim 1 wherein the stiff member is U-shaped and comprises a first arm disposed adjacent to said object, and a second arm cooperating with said first arm to engage said clothing article.

3. The device of claim 2 wherein said first arm comprises an upper, an intermediate and a lower cut-out, said wire member being reciprocatively mounted in said upper and lower cut-outs with the end section extending through said intermediate cut-out.

4. The device of claim 3 wherein said intermediate cut-out has a lower edge disposed to rotate said end section toward said first arm as said wire is translated from said first to said second position.

5. The device of claim 3 wherein said flexible member has another end, said device further comprising a cap affixed to said another end and extending through said upper cut-out, for moving said flexible member.

6. The device of claim 1 wherein said stiff member is tubular for engaging an article with a rod-shaped element.

7. The device of claim 1 wherein said stiff member is adapted to engage a belt on a skirt.

8. The device of claim 1 wherein said flexible member comprises a U-shaped wire.

9. The device of claim 1 wherein said flexible member comprises a substantially straight stiff portion and a spike pivotally affixed to said stiff portion.

10. The device of claim 1 further comprising a spring disposed between said stiff and flexible member for urging said flexible member toward said first position.

* * * * *